United States Patent [19]

Chamberlain

[11] Patent Number: 4,472,944

[45] Date of Patent: Sep. 25, 1984

[54] DIESEL AND ELECTRIC HYDRAULIC SYSTEMS FOR TRANSPORTATION

[76] Inventor: Neil W. Chamberlain, P.O. Box 483, Hyattsville, Md. 20782

[21] Appl. No.: 449,928

[22] Filed: Dec. 15, 1982

[51] Int. Cl.[3] ..... F01B 21/00

[52] U.S. Cl. ..... 60/718

[58] Field of Search ..... 60/698, 716, 717, 718; 180/65 A, 65 B, 65 C, 65 R

[56] References Cited

U.S. PATENT DOCUMENTS 4,027,485 6/1977 Wallis ..... 60/718 X 4,407,132 10/1983 Kawakatsu ..... 60/716

*Primary Examiner*—Allen M. Ostrager

*Attorney, Agent, or Firm*—Jones, Tullar & Cooper

[57] ABSTRACT

A power system for powering ships, automobiles, submarines, trains, industrial applications and other types of equipment is disclosed. The system includes an internal combustion engine and two electric motors which are selectively engageable with output shafts. Also provided is an electrical generator and a battery which supply the necessary electrical power to the motor and the internal combustion engine's starter. Three hydraulic systems, each comprised of a pump, motor, 2 fluid reservoirs and associated connecting lines, are utilized to connect the internal combustion engine with the generator, the electric motors with the generator and the electric motor with the output shafts. The system is both economical and versatile in that it is adapted for operation in a first mode wherein the internal combustion engine supplies power to the output shaft and in a second mode wherein the internal combustion engine, the generator, electric motors and battery supply power to operate the output shaft. A third mode wherein the generators and electric motors and battery supply power to the output shaft is also available.

1 Claim, 1 Drawing Figure

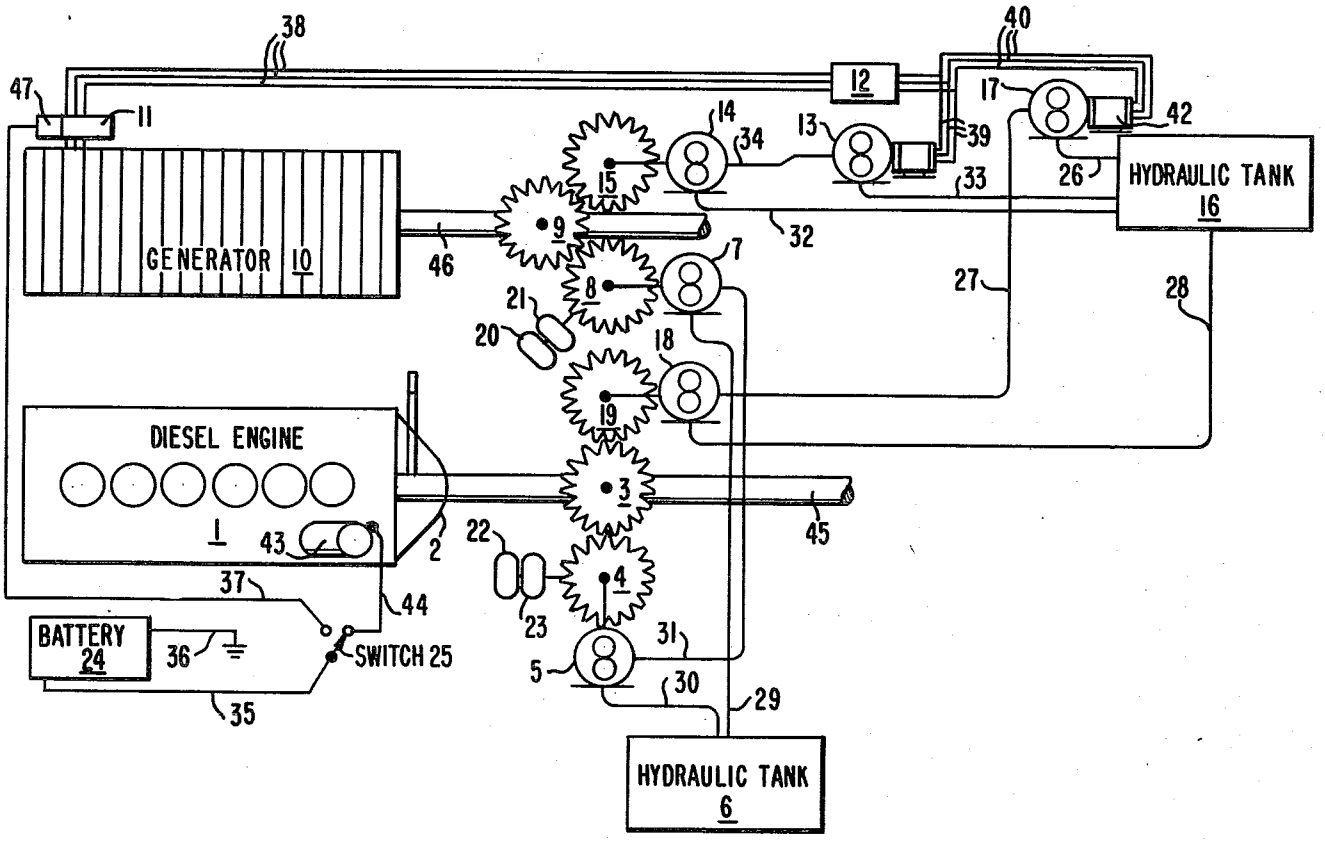
HYDRAULIC TANK 16
HYDRAULIC TANK 6
GENERATOR 10
DIESEL ENGINE 1
BATTERY 24
SWITCH 25

DIESEL AND ELECTRIC HYDRAULIC SYSTEMS FOR TRANSPORTATION

BACKGROUND OF THE INVENTION

This application relates to the subject matter of Disclosure Document No. 110322, filed Sept. 13, 1982.

The present invention relates to a power system for powering ships, railroad trains, automobiles, buses and submarines or various other industrial applications, which system utilizes a plurality of hydraulic pump or motor systems to interconnect the various elements of the power system in such a way that the consumption of fuel oil by the vehicle is reduced to a minimum.

The use of hydraulic systems to interconnect various elements in a power system is known. For example, in U.S. Pat. No. 3,283,165, to Bloch, a no-break power system is disclosed wherein a motor is adapted to drive an alternator through a hydraulic pump and motor system. An internal combustion engine is also provided to drive the alternator; however, the engine is connected to the alternator through a clutch and drive shaft and not a hydraulic system.

As another example of the use of hydraulics in a power system, U.S. Pat. No. 4,086,768, to Eickmann, discloses a driving and controlling unit for a vehicle wherein systems of hydraulics and motors are used to drive vehicles and boats by diesel or gasoline engines.

Neither of the above patents, however, discloses a power system wherein two diverse power sources and an electrical generator are connected to one another with gearing and hydraulics. The present invention serves to provide such a system wherein both an internal combustion engine and an electric motor may be selectively coupled to a generator via hydraulic systems and in addition, the electric motor may be coupled to an output or drive shaft by yet another hydraulic system. The use of multiple hydraulic systems in this manner is economical and provides the desired multiplication of torque between the various elements.

SUMMARY OF THE INVENTION

It is a specific object of the present invention to provide a power system which will provide a continuous source of power.

Another object of the invention is to provide a power system which is both versatile and economical.

A still further object of the invention is to provide a power system which may be adapted to a variety of industrial and automotive applications.

Briefly, the foregoing and other objects of the invention are accomplished through the use of a plurality of power generating and transmitting elements which are interconnected to one another through a plurality of hydraulic systems. Specifically, the invention comprises an internal combustion engine which is connected through a clutch to an output or drive shaft. Disposed on the drive shaft is a gear which is adapted to be engaged with a pair of additional gears. One of the additional gears serves as a means by which the internal combustion engine may drive an electrical generator through a first hydraulic system comprised of a pump, line, motor and reservoir, and gearing disposed between the hydraulic motor and the generator shaft. The second of the additional gears serves as a means by which the electric motors may drive the output shaft through a second hydraulic system. A third hydraulic system is also provided which serves in conjunction with associated gearing as a means for connecting the electric motors to the generator.

Battery means are also provided to absorb any excess power generated by the generator and to provide electrical power for the electric motors or the internal combustion engine starter when the generator output is not sufficient. A power bus and control panel electrically interconnects the battery, starter, motor and generator.

Finally, means are provided whereby the hydraulic motors or pumps and their associated gears may be mounted for transverse movement relative to the output and generator shafts so that the motor or pump gears may be selectively engaged with the gears disposed on these shafts. This enables the power system to have a versatility wherein the various elements may be interconnected in a number of different operating modes depending on the particular power requirements placed on the system at any given time.

BRIEF DESCRIPTION OF THE DRAWINGS

The foregoing and additional objects, features and advantages of the present invention will become more apparent to those of skill in the art from a consideration of the following embodiment thereof taken in conjunction with the accompanying FIGURE of the drawing which is a diagrammatic illustration of a preferred embodiment of the present invention as may be applied to use in powering a ship or tanker.

DETAILED DESCRIPTION OF THE DRAWING

A diesel engine 1 is connected through a clutch 2 to gear 3. This is the drive gear on the shaft 45 that will operate gear 4 and gear 19.

Hydraulic pump 5 is driven by gear 4 which operates from gear 3 when the diesel is operating. This pump then operates motor 7 and its gear 8 through hydraulic lines 29, 30 and 31 connected between the pump 5, motor 7, and a fluid tank 6. Line 3 is the pressure line, and line 29 is the return line to tank 6. Gear 8 turns the shaft on the generator 10 by turning gear 9. Gear 8 is an adjustable gear and gear 4 is an adjustable gear indicating that these may be connected to mesh with the other gears by hydraulics explained from 21 to 23. Gear 9 is on the generator shaft 46 and is driven by either or both gear 8 and gear 15.

The generator has a control panel 11 which includes an inverter to change the battery from D.C. to A.C. and the necessary switches to control the generator output. The generator output on lines 38 is connected through overload circuit breakers 12 to electric motors 41 and 42, the circuit breakers serving to protect the generator output.

Hydraulic pump 13 operates hydraulic motor 14 by pressure line 34. The motor 14 drives a gear 15 which turns gear 9 on the generator shaft 46. The hydraulic fluid is transferred by hoses 32 and 33. Hydraulic tank 16 supplies fluid to hydraulic pump 13 through hose 37 and to hydraulic pump 17 through hose 26. Two hydraulic tanks 16 and 6 are provided for two different systems so that the possibility of overheating fluid may be reduced. Hydraulic pump 17 operated by electric motor 42 is supplied by fluid through line 26 and forwards the fluid by line 27 going to hydraulic motor 18 which turns gear 19 which turns gear 3 on the output shaft 45. Hydraulic line 28 is the return line to tank 26. After the two systems are balanced and the power is sufficient, it is at this point that the clutch may be disengaged from the diesel and gear 8 and gear 4 through slave cylinders 20 through 23 may be disengaged in the event of a fault in the diesel. This will allow the standby power source (battery) to drive shaft 45 for a time. The flywheel effect of the rotating generator will also supply some power.

Slave cylinders, 20 and 21 engage and disengage gear 8 of the generator gear drive assembly. Slave cylinders 22 and 23 are used to engage or disengage gear 4.

A 24 volt battery 24 is connected to a switch 25 and cables 35 and 36. Switch 25 by cable 44 can forward electricity to the diesel starter 43. Cable 37 operates off of switch 25 and leads to the generator control panel when it goes into a D.C./A.C. rectifier. Number 27 is the hydraulic line from pump 17 to motor 18. Number 28 is the return line from hydraulic motor 18 to hydraulic tank 16. Number 29 is the return line from hydraulic motor 7 to hydraulic tank 6. Number 30 is the line from hydraulic tank 6 to hydraulic pump 5. Number 31 is the pressure line from hydraulic pump 5 to hydraulic motor 7. Number 32 is the return from hydraulic motor 14 to hydraulic tank 16. Number 33 is the supply line for hydraulic pump 13 and 34 is the pressure line from hydraulic pump 13 to hydraulic motor 14. Number 35 is the positive cable from battery 24 to switch 25. Number 36 is the negative cable from battery 24 to switch 25. Number 37 is the cable from the switch to the generator panel. Number 38 are the 220 wires from panel 11 to circuit breakers 12. Number 39 are the wires from motor 41 to panel 12 and 40 are the wires from panel 12 to motor 42. Number 41 is the electric motor which drives hydraulic pump 13. Number 42 is the electric motor which drives hydraulic pump 17. Number 43 is the diesel engine starter which is connected to switch 25. Number 44 is the battery cable from switch 25 to the starter.

The propeller shaft 45 carries gear 3 and 46 is the shaft of the generator assembly which carries gear 9. Number 47 is the inverter from D.C. to A.C. in panel 11.

A brief explanation of the system would be as follows.

1—The diesel engine is started and drives the hydraulic fluid to turn the generator 10 and after the generator is operating at a reasonable rate of output which is far in excess of that required. It is our intention also to have excess electricity to provide for lighting and other necessities on the ship or train or whatever type or installation may be required.

2—While the diagram indicates that all of the gears are the same size depending on the load capacity, gears may be changed in diameter such as gear 15 and gear 19 in order to increase the torque and by varying pump and motor sizes much greater torque can be developed giving excess capacity to operate the system far beyond what you might call normal requirements.

Although the present invention has been described in terms of a preferred embodiment wherein a power system is disclosed for powering boats or ships, it will be understood that slight variations could be made to adapt the invention to other uses. For example, the system could be installed in motor vehicles and industrial type applications. These and such other modifications and variations as will be evident to those of skill in the art are within the true spirit and scope of the invention as defined in the following claim.

What is claimed is:

1. A power system for use in powering ships, trains, automobiles, or any other vehicles comprising:

an internal combustion engine having an output shaft and a clutch disposed thereon;

an electrical starter for said internal combustion engine;

a drive shaft being connected at one end to said clutch and at the other end to vehicle drive means;

a first gear fixedly disposed on said drive shaft between said clutch and said vehicle drive means for rotation with said drive shaft;

a second gear selectively engageable with said first gear;

a first hydraulic pump having a fluid inlet and outlet and being connected to and driven by said second gear;

an electrical generator having an input shaft;

a third gear disposed on and rotatable with said input shaft;

a fourth gear selectively engagable with said third gear;

a first hydraulic motor having a fluid inlet and outlet and being connected to said fourth gear;

means to connect the output of said first hydraulic pump to the input of said first hydraulic motor;

electric storage battery means;

first and second electric motors, the first being connected to drive the generator and the second being connected to drive said drive shaft;

electrical connecting means for selectively interconnecting the generator output, said battery, said electric motors, and said engine starter;

a second hydraulic pump having a fluid inlet and outlet and being connected to the output shaft of said second electric motor;

a fifth gear engagable with said first gear;

a second hydraulic motor having a fluid inlet and outlet and being connected to said fifth gear;

means to connect the output of said second hydraulic pump to the inlet of said second hydraulic motor;

a third hydraulic pump having a fluid inlet and outlet and being connected to the output shaft of said first electric motor;

a sixth gear engagable with said third gear;

a third hydraulic motor having a fluid inlet and outlet and being connected to said sixth gear; and, means to connect the output of said third hydraulic pump to the inlet of said third hydraulic motor.

* * * * *